United States Patent [19]

Villazon

[11] 4,066,321

[45] Jan. 3, 1978

[54] ELECTRICAL CONNECTOR

[75] Inventor: Francisco Villazon, Barcelona, Spain

[73] Assignee: AMP Incorporated, Harrisburg, Pa.

[21] Appl. No.: 755,523

[22] Filed: Dec. 30, 1976

[30] Foreign Application Priority Data

Jan. 17, 1976 United Kingdom ..... 1846/76

[51] Int. Cl.[2] ..... H01R 7/04

[52] U.S. Cl. ..... 339/98; 339/113 R

[58] Field of Search ..... 339/59, 75 P, 97–99, 339/276 SF, 113 R, 113 B

[56] References Cited

U.S. PATENT DOCUMENTS

| | | | |
|---|---|---|---|
| 2,931,006 | 3/1960 | Klumpp, Jr. | 339/59 M |
| 3,202,957 | 8/1965 | Leach | 339/98 |
| 3,344,393 | 9/1967 | Hendee | 339/75 P |
| 3,835,444 | 9/1974 | Plana et al. | 339/98 |
| 3,923,362 | 12/1975 | Dunn et al. | 339/99 R |

*Primary Examiner*—Joseph H. McGlynn
*Attorney, Agent, or Firm*—Allan B. Osborne

[57] ABSTRACT

An electrical connector for electrically connecting the conductive cores of insulated wires has external bosses on its housing to indicate the type of connection provided by the connector.

3 Claims, 6 Drawing Figures

FIG.1.
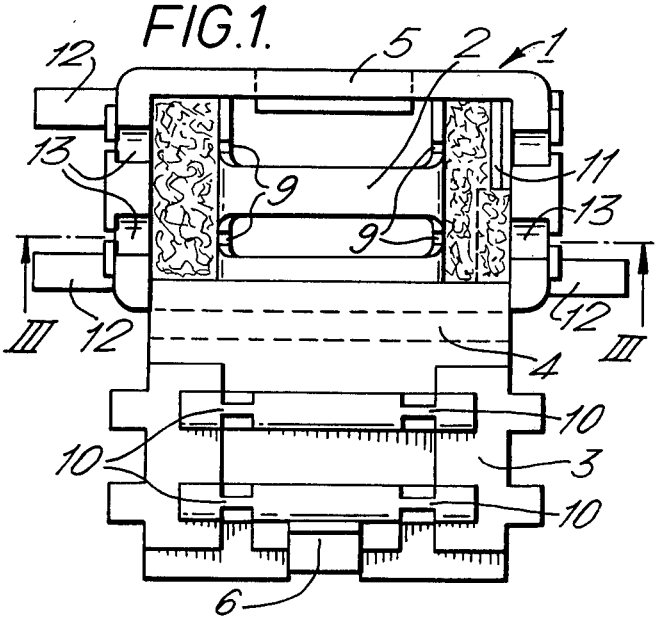
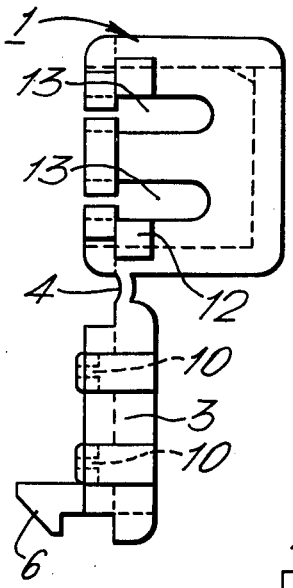
FIG.2.
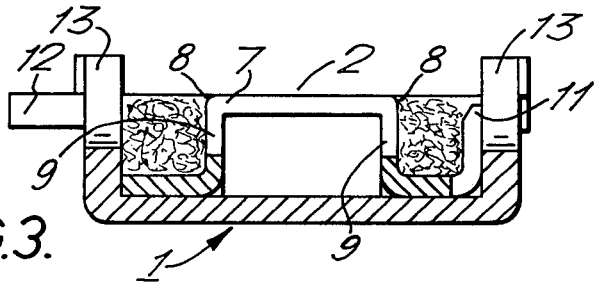
FIG.3.

ELECTRICAL CONNECTOR

This invention relates to an electrical connector and to a strip of such electrical connectors.

In U.S. Pat. No. 3,835,444 there is described an electrical connector for electrically connecting the conductive cores of insulated wires, the connector comprising an insulating housing having an aperture for providing access to the interior of the housing, a closure member hingedly connected to the housing at one side and movable to a closed position to close the aperture in the housing, the housing and closure members having co-operating latching members which engage to latch the closure member to the housing in the closing position, the housing containing first and second metal plates positioned with an edge of each plate facing the aperture in the housing, there being a plurality of slots opening into such edges of each plate, each slot in each plate bing aligned with a slot of the other plate and being capable of receiving an insulated wire forced into the slot by the closure member as the closure member is moved to its closed position, so that the edges of the slot penetrate the insulation of the wire to make electrical contact with the conductive core of the wire, there being a wire severing edge associated with only one slot of at least one of the pairs of aligned slots and disposed on the side of the slot remote from the other slot of the aligned pair, the or each wire serving edge being positioned for co-operation with the closure member to trim a wire received in the associated slot as the wire is forced into the slot by the closure member.

Preferably the housing has wire receiving notches in its end walls each aligned with one of the slots, and through which wires to be connected by the connector can enter and leave the housing.

Such connectors are especially suitable for interconnection of the wires of multi-wire telephone cables to provide splice or tap connections thereon.

The type of connection eg. tap, butt splice or through splice, for which any connector is of use, is determined by the number and positioning of the wire severing edges provided in the connector. For example, considering connectors for two wires, a tap connector would have only one wire severing edge, a butt splice would have two wire severing edges both at the same end of the connector, and a through splice connector would have two wire severing edges, one at each end of the connector and for different wires.

Clearly in a collection of such connectors containing more than one type of the connector, it would be difficult to select a required connector of a particular type by searching on the basis of looking for a connector having the correct number of wire severing edges in the correct positions, and thus it would be advantageous if the connector housing were clearly externally coded to indicate the type of connector.

According to this invention an electrical connector of the type set out above has an external boss on the housing adjacent either the or each wire receiving notch having no wire severing edge associated with the aligned slot, or the or each wire receiving notch having a wire severing edge associated with the aligned slot.

Thus, a connector according to this invention is readily identifiable as to type from the number and positioning of the external bosses on the housing, this also indicating the manner in which wires are to be introduced into the connector.

A further advantage of the connector of this invention is that a plurality thereof can be provided in strip form with the housings thereof joined end to end by means of bosses. Such provision of a plurality of connectors renders them suitable for use with automatic or semi-automatic application tooling.

Initially with such a strip of housings there will be a boss on each housing adjacent each wire receiving notch therein, but when the housings are cut from the strip the connecting bosses can be cut so as to give each housing the required coding as discussed above. Such cutting of the strip can be carried out either manually or automatically by an appropriately set up application tool.

This invention will now be described by way of example with reference to the drawings, in which:

FIG. 1 is a plan view of a tap connector according to the invention; and

FIG. 2 is an end view of the connector of FIG. 1;

FIG. 3 is a section on the line III-III in FIG. 1;

Figure 4:
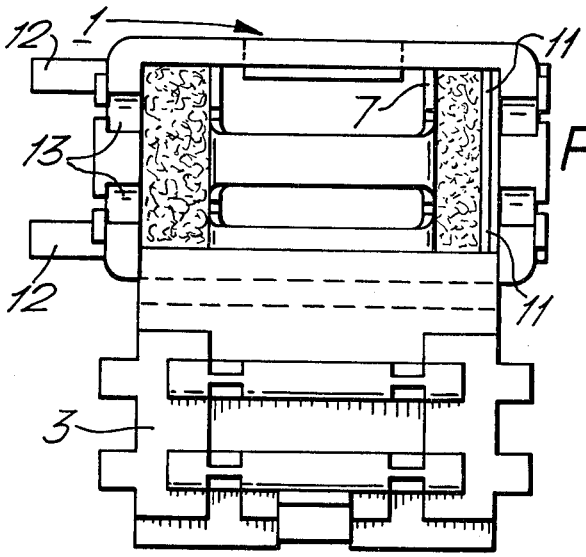
FIG. 4 is a plan view of a butt splice connector according to the invention.

Referring to FIGS. 1 to 3, the connector here shown is for electrically connecting the conductive cores of two insulated wires (not shown) and comprises an insulating housing 1 having an aperture 2 for providing access to the interior of the housing 1. A closure member in the form of a lid 3 is hingedly connected at 4 to the housing 1 and is movable to a closed position to close the aperture 2. The housing 1 and lid 3 have co-operating latching members comprising a recess 5 and a shouldered arm 6 which engage in known manner to latch the lid 3 to the housing 1 in the closed position.

The housing 1 contains an electrical contact 7 (FIG. 3) which provides two edges 8 which face the aperture 2, there being two slots 9 which open into each edge 8 of the contact 7. The slots 9 are arranged in two pairs, the slots of each pair being coaxial and with their axis parallel to and spaced from that of the other pair of slots.

For use of the connector an insulated wire is positioned over each pair of aligned slots 9 and the lid 3 is then moved to its latched closed position over the aperture 2 such that suffer portions 10 on the lid 3 urge the wires into the slots 9 thereby electrically to connect the wires to the contact 7, and thus to each other in known manner, the wires entering the housing 1 through wire receiving notches 13 in the end walls of the housing 1.

As mentioned the connector shown in FIGS. 1 to 3 is for making tap connections, and thus one wire is to pass through the connector while the other wire terminates at the connector.

The connector thus has one wire severing edge 11 formed on the contact 7 in line with one of the slots 9, this being the top right-hand slot in FIG. 1, between the associated slot 9 and the end of the housing 1. In use of the connector, the wire severing edge 11 co-operates with the lid 3 to trim the wire received in the associated slot 9 as the wire is forced into the slot 9 by the lid 3. This wire only is thus terminated at the connector as necessary as described above, to provide the desired tap connection.

In order to indicate to a user of the connector the type of the connector, that is that it is a connector for providing a tap connection, and also to indicate the position of the wire severing edge 11 in the connector, the housing 1 is provided with three external bosses 12 adjacent the three wire receiving notches 13 in the ends of the housing 1, through which a connected wire will enter the connector. No boss 12 is provided adjacent the wire receiving notch 13 aligned with the wire severing edge 11 since no connected wire will enter the housing 1 through this notch 13 after closing the lid 3.

Thus, the three bosses 12 code the connector to indicate that it is a connector to provide a tap connection, and that the through wire must be positioned in the lower pair of slots 9 in FIG. 1, while the tap wire must be positioned in the upper pair of slots 9 in FIG. 1 to leave the connector by the upper left-hand slot in FIG. 1.

Figure 5:
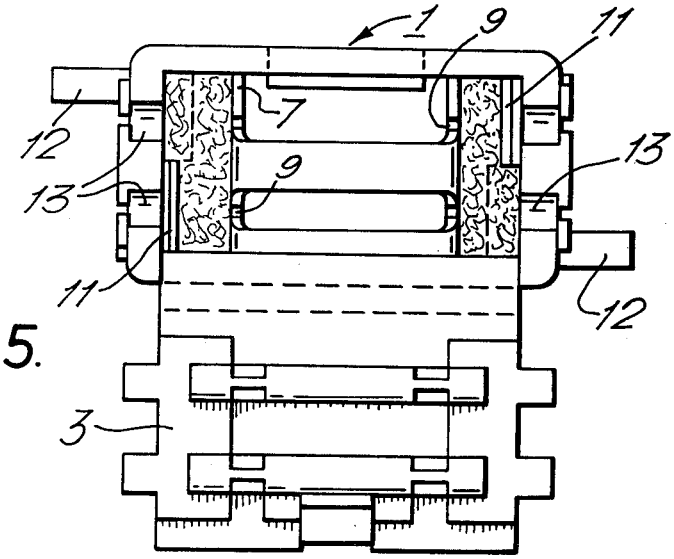
FIG. 5 is a plan view of a through splice connector according to the invention.

FIGS. 4 and 5 show views of connectors similar to that of FIG. 1, and will not therefore be described in detail. The only difference between the connectors shown are in the number and/or positioning of wire severing edges 11, and thus in the number and/or positioning of bosses 12.

The connector shown in FIG. 4 is for providing a butt splice connection between two wires, and thus has two wire severing edges 11 integrally formed with the contact 7 at one end of the housing 1, the other end of the housing 1 being formed with two bosses 12 to indicate the two notches 13 through which the wires must enter the connector. There are no bosses 12 at the end of the housing 1 at which the wire severing edges 11 are positioned.

The connector shown in FIG. 5 is for providing a through splice connection between two wires, and thus has two wire severing edges 11 formed on the contact 7 at opposite ends of the housing 1 and each associated with a slot 9 of an individual one of the pairs of aligned slots 9, and two bosses 12 at opposite ends of the housing 1 and associated with the notches 13 remote from the wire severing edges 11.

Figure 6:
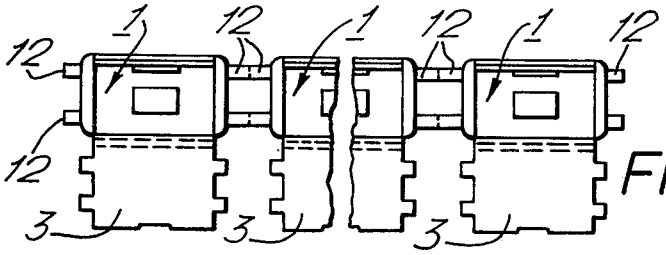
FIG. 6 is a diagrammatic plan view of a strip of connectors according to the invention.

Referring not to FIG. 6, this shows how a plurality of connector housings 1 as shown in FIGS. 1 to 5 can be formed integrally in a strip, joined end to end by means of bosses 12. When a contact has been mounted in a housing 1 to make a connector for a particular type of connection, then this connector is cut from the strip by cutting the bosses 12 to give the connector the appropriate boss coding to indicate its type and arrangement as discussed above.

Although in the connectors described above the bosses 12 are provided adjacent the notches 13 having no wire severing edges 11 associated therewith, it will be appreciated that the opposite arrangement in which the bosses 12 are provided adjacent the notches 13 having wire severing edges 11 associated therewith, it equally possible.

Further, as indicated in the drawings, the portions of the housing 1 between the slots 9 and the adjacent end walls of the housing 1, or the associated wire severing edges 11, contain a grease or a like sealing material in order to seal the connector hermetically when applied to wires to be connected.

What is claimed is:

1. An improvement to an electrical connector of the type having a housing having notches on its end walls and containing first and second electrical contacts with each contact having spaced apart wire-receiving slotted plates, said plates being in alignment with said notches, and at least one wire severing edge associated with at least one of said notches and a closure member adapted to force insulated wires into the slotted plates and to force at least one wire across the wire severing edge, the improvement comprising, an external boss on the housing adjacent each of said notches through which the wires may extend after being forced into the slotted plates.

2. A plurality of housings for use in the production of electrical connectors as claimed in claim 1, the housings being formed integrally with each other in a strip, joined end to end by means of the bosses thereon.

3. An improvement to an electrical connector of the type having a housing having notches on its end walls and containing first and second electrical contacts with each contact having spaced apart wire-receiving slotted plates, said plates being in alignment with said notches, and at least one wire severing edge associated with at least one of said notches and a closure member adapted to force insulated wires into the slotted plates and to force at least one wire across the wire severing edge, the improvement comprising, an external boss on the housing adjacent each of said notches having a wire severing edge associated therewith.

* * * * *